US009476327B2

(12) United States Patent
Weber et al.

(10) Patent No.: US 9,476,327 B2
(45) Date of Patent: Oct. 25, 2016

(54) CAMSHAFT ADJUSTING DEVICE

(71) Applicant: Schaeffler Technologies GmbH & Co. KG, Herzogenaurach (DE)

(72) Inventors: Juergen Weber, Erlangen (DE); Robert Heinemann, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/394,071

(22) PCT Filed: Mar. 22, 2013

(86) PCT No.: PCT/EP2013/056098
§ 371 (c)(1),
(2) Date: Oct. 10, 2014

(87) PCT Pub. No.: WO2013/174543
PCT Pub. Date: Nov. 28, 2013

(65) Prior Publication Data

US 2015/0083065 A1 Mar. 26, 2015

(30) Foreign Application Priority Data

May 22, 2012 (DE) ..... 10 2012 208 496

(51) Int. Cl.
*F01L 1/34* (2006.01)
*F01L 1/344* (2006.01)
*F01L 1/047* (2006.01)

(52) U.S. Cl.
CPC ..... *F01L 1/344* (2013.01); *F01L 1/047* (2013.01); *F01L 1/3442* (2013.01); *F01L 2103/00* (2013.01)

(58) Field of Classification Search
CPC ..... F01L 1/34; F01L 1/047; F01L 1/3442; F01L 2103/00
USPC ..... 123/90.17, 90.15
See application file for complete search history.

(56) References Cited

U.S. PATENT DOCUMENTS

| | | | | |
|---|---|---|---|---|
| 6,412,462 | B1 * | 7/2002 | Lichti | F01L 1/3442 123/90.17 |
| 8,677,960 | B2 | 3/2014 | Knecht et al. | |
| 8,800,512 | B2 | 8/2014 | Strauss | |
| 2012/0132160 | A1 | 5/2012 | Malen et al. | |
| 2013/0213331 | A1 | 8/2013 | Landersdorfer et al. | |
| 2013/0247855 | A1 | 9/2013 | Adachi et al. | |

FOREIGN PATENT DOCUMENTS

| | | |
|---|---|---|
| CN | 102016243 | 4/2011 |
| CN | 102373981 | 3/2012 |
| DE | 101 61 701 | 6/2003 |

(Continued)

*Primary Examiner* — Ching Chang
(74) *Attorney, Agent, or Firm* — Davidson, Davidson & Kappel, LLC

(57) ABSTRACT

A camshaft adjusting device (19) having a camshaft adjuster (4), including a stator (36), a rotor (38) which can be rotated relative to the stator (36) about a rotational axis (74), and a hub (52) which is arranged on the rotor (38) or on the stator (36) and has a receiving cup (62), and having a camshaft (12) which is received in the receiving cup (62). It is provided here that the camshaft (12) is fixed radially in the receiving cup (62) via at least three spacer elements (64). A camshaft adjusting device (19) of this type can be produced simply and inexpensively.

9 Claims, 6 Drawing Sheets

(56) References Cited * cited by examiner

FOREIGN PATENT DOCUMENTS

| | | |
|---|---|---|
| DE | 102008019746 | 10/2009 |
| DE | 10 2008 033812 | 1/2010 |
| DE | 102010046619 | 3/2012 |
| WO | WO 2012/111388 | 8/2012 |

CAMSHAFT ADJUSTING DEVICE

The present invention relates to a camshaft adjusting device having a camshaft adjuster, which includes a stator, a rotor which is rotatable relative to the stator around a rotation axis, and a hub situated on the rotor or on the stator and having a receiving bushing, as well as a camshaft accommodated in the receiving bushing. In particular, the present invention deals with the problem of centering the camshaft adjuster on the camshaft.

BACKGROUND

Via the hub, the camshaft adjuster of a camshaft adjusting device of the type mentioned at the outset is rotatably fixedly connected to the crankshaft of an internal combustion engine. The phase angle between the crankshaft and the camshaft may be set with the aid of the relative rotatability of the rotor relative to the stator.

A camshaft adjusting device is known from DE 101 617 01 A1, in which the camshaft is accommodated in a receiving bushing in the rotor of the camshaft adjuster for the purpose of centering with the aid of the camshaft adjuster. The receiving bushing of the hub is designed as a centering opening having an uninterrupted circular surface. The centering opening additionally has an area which is reduced in diameter for the purpose of centering. The camshaft is fixed on the rotor with the aid of a central screw.

SUMMARY OF THE INVENTION

It is an object of the present invention to provide a camshaft adjusting device which is easy and economical to manufacture and which permits a preferably secure centering of the camshaft or the camshaft adjuster on the camshaft.

The present invention provides a camshaft adjusting device of the type mentioned at the outset in which the camshaft is radially fixed in the receiving bushing with the aid of at least three spacer elements.

In a first step, the present invention is based on the consideration that a receiving bushing of the hub, into which the camshaft is centrically inserted, must be manufactured or machined within very narrow tolerances, so that the inserted camshaft does not generate an imbalance with respect to the rotation axis of the camshaft adjuster. The required low tolerances are achieved in terms of manufacturing by complex manufacturing or machining. For example, the receiving bushing must be rotated to achieve the necessary low tolerances on the circumferential line. This disadvantageously increases the costs and the cycle times for manufacturing.

In a second step, the present invention recognizes that, if the camshaft is to be centrically accommodated on the camshaft adjuster, a rotation may be dispensed with according to the operating principle of a chuck. If the camshaft is fixed radially in the receiving bushing with the aid of at least three spacer elements, the receiving bushing as such no longer has to be manufactured with the required low tolerances. Instead, the spacer elements establish the radial position of the camshaft. In other words, an interrupted centering surface is provided, so that a rotation of the receiving bushing is no longer needed for manufacturing. Only the small number of spacer elements must be manufactured in a defined manner with respect to their radial contact surfaces or contact points.

In particular, the present invention makes it possible to manufacture the hub including the receiving bushing or the rotor or the stator including the receiving bushing without machining or with the aid of a cost-effective sintering. The corresponding individual parts are initially powder-metallurgically pressed into mold parts to form a green compact and subsequently sintered. Only the tolerances of the interrupted centering surface, i.e., of the radial contact surfaces or contact points of the spacer elements as well as, if necessary, the base of the receiving bushing are subsequently set with the aid of a form tool. The form tool may be, for example, a mandrel, a stamp or a die. This setting of the tolerances is also known under the term "calibration."

In other words, the present invention also provides a method for manufacturing a camshaft adjusting device of the type mentioned at the outset, a rotor and a stator being provided and assembled, rotatable relative to one another, to form a camshaft adjuster, and the camshaft adjuster being centered on a camshaft. According to the present invention, it is provided that a hub, which includes a receiving bushing and at least three spacer elements, is powder-metallurgically manufactured for the rotor or for the stator, that the radial tolerances of the spacer elements are set with the aid of calibration and that the camshaft is introduced into the receiving bushing and fixed radially with the aid of the spacer elements.

The rotor or the stator itself, or only the corresponding hub parts, may be powder-metallurgically manufactured. The spacer elements are preferably manufactured together with the receiving bushing, and the radial tolerances of the spacer elements manufactured together with the receiving bushing are set with the aid of calibration. However, it is also possible to manufacture the spacer elements separately and to subsequently insert them into the receiving bushing. The spacer elements may also be mounted on or manufactured together with the camshaft. The spacer elements may be mounted, for example, on a support or the like, which may be inserted into the receiving bushing as a component independent of the camshaft adjuster. In this way, a centering having an accuracy which is independent of the remaining components of the camshaft adjuster may be achieved. It is also possible to introduce the spacer elements radially between the wall of the receiving bushing and the camshaft entirely without fastening. After the radial tolerances of the spacer elements are set, the camshaft is introduced into the receiving bushing and fixed radially.

In one preferred embodiment of the present invention, at least two of the spacer elements are situated offset from each other in the axial direction. Due to this measure, the camshaft is definitively fixed in its axial alignment, in particular aligned along the rotation axis without a tilt. In the case of a punctiform support of the camshaft on spacer elements situated in an axial plane, mechanical deformation may possibly cause an indeterminacy in the axial direction of the camshaft.

In one advantageous refinement, the spacer elements extend in the axial direction. This permits a concrete fixing of the camshaft in the axial direction, since, in the axial direction, the camshaft is guided along the spacer element, for example at multiple points or on a surface or an edge.

The spacer elements advantageously taper toward the camshaft in the radial direction for the purpose of minimizing the active contact surface between the spacer elements and the camshaft, so that multiple contact points with the camshaft, which over-determine the centering of the camshaft, do not occur on the individual spacer elements themselves. The thickness of the spacer elements preferably tapers on a plane perpendicular to the axial direction, while retaining a certain axial extension, so that an axial contact line toward the camshaft results on each of the spacer elements.

In an additional refinement, the spacer elements extend in the axial direction to a base of the receiving bushing, indentations being introduced into the base, which surround each of the spacer elements. In other words, the indentations are situated directly in the root area of the spacer elements. The indentations in the root area of the spacer elements may also be provided by sintering and/or pressing. The indentations facilitate a flat contact of the front side of the camshaft on the base of the receiving bushing, without an edge-carrying outer rim of the camshaft striking in the radial transition in the root area. Upon finally tightening a camshaft mounted on an edge seat in the root area, for example with the aid of a central screw, the camshaft may undesirably tilt or twist later on, which may result in serious subsequent damages.

At least one form-fitting element is furthermore advantageously situated on a base of the receiving bushing, which is rotatably fixedly coupled with a complementary form-fitting element on the front of the camshaft. Due to the additional form fit between the front and the base of the receiving bushing, higher torques may be transmitted than in the case of a flat support. A form fit of this type also permits an angle-coded installation of the camshaft. For this purpose, the form-fitting elements are designed in such a way that the camshaft may be inserted into the receiving bushing all the way to the base only in one single, defined angular position. The phase angle of the camshaft on the camshaft adjuster may be predefined thereby, for example during assembly.

The form-fitting elements situated on the base may, in particular, also taper in the axial direction, so that, when the camshaft is tightened on the camshaft adjuster, for example with the aid of a central screw, they bore, dig or cut into the front side, thereby compensating for any tolerances that may exist.

In one refinement of the present invention, the spacer elements are situated on an inner lining of the receiving bushing and may particularly preferably be provided as a single piece with the inner lining. In this way, the rotor or the stator may be manufactured using a simple sintering process, the individual spacer elements being brought to the tolerances necessary for centering the camshaft after the sintering process with the aid of calibration.

In one advantageous embodiment, the receiving bushing is situated on a rotor of the camshaft adjuster. In this case, the camshaft adjuster is mounted together with the rotor on the camshaft, the latter being accommodated in a centered manner in the receiving bushing of the rotor. The stator is then driven by the crankshaft, in particular using a chain drive. The angle between the camshaft and the crankshaft is set with the aid of the phase angle of the rotor relative to the stator. Alternatively, the receiving bushing may be situated in a stator if the stator must be accommodated centrally or centered relative to the camshaft. The stator is then joined directly to the camshaft or supported on it radially. This is the case, in particular, in a camshaft which surrounds an inner shaft and an outer shaft concentric thereto, the stator being connected to the inner shaft and the rotor to the outer shaft.

BRIEF DESCRIPTION OF THE DRAWINGS

Exemplary embodiments of the present invention are explained in greater detail below on the basis of a drawing.

DETAILED DESCRIPTION

Figure 1:
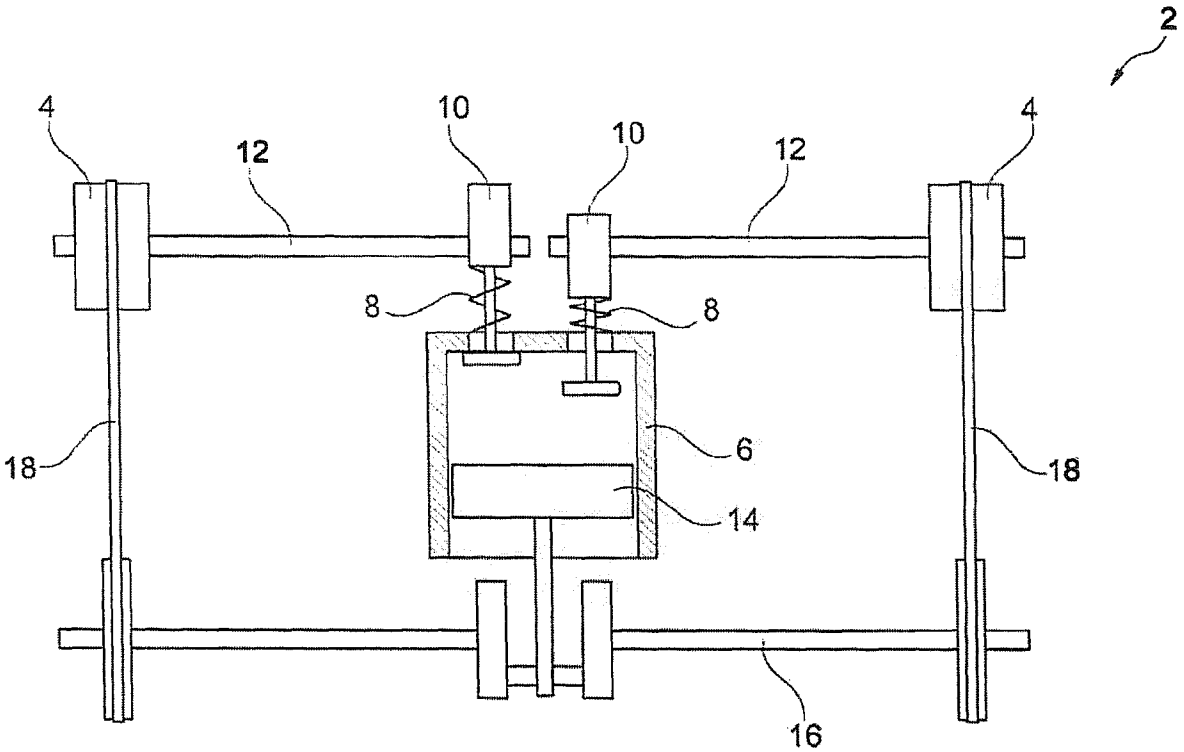
FIG. 1 shows a schematic representation of an internal combustion engine including camshaft adjusters.

In the figures, the same elements are provided with the same reference numerals and described only once.

Reference is hereby made to FIG. 1, which shows a schematic representation of an internal combustion engine 2, including camshaft adjusters 4.

In a manner which is known per se, internal combustion engine 2 includes a combustion chamber 6, which may be opened and closed with the aid of valves 8. The valves are activated by cams 10 on corresponding camshafts 12. A reciprocating piston 14, which drives a crankshaft 16, is accommodated in combustion chamber 6. The rotation of crankshaft 16 is transmitted on its axial end to camshaft adjusters 4 via driving means 18. In the present example, the driving means may be a chain or a belt.

Camshaft adjusters 4 are each mounted axially on camshafts 12, absorb the rotation energy of driving means 18 and transfer it to camshafts 12. Camshaft adjusters 4 are thus able to temporarily decelerate or accelerate the rotation of camshafts 12 with respect to crankshaft 16 for the purpose of changing the phase angle of camshafts 12 with respect to crankshaft 16.

Figure 2:
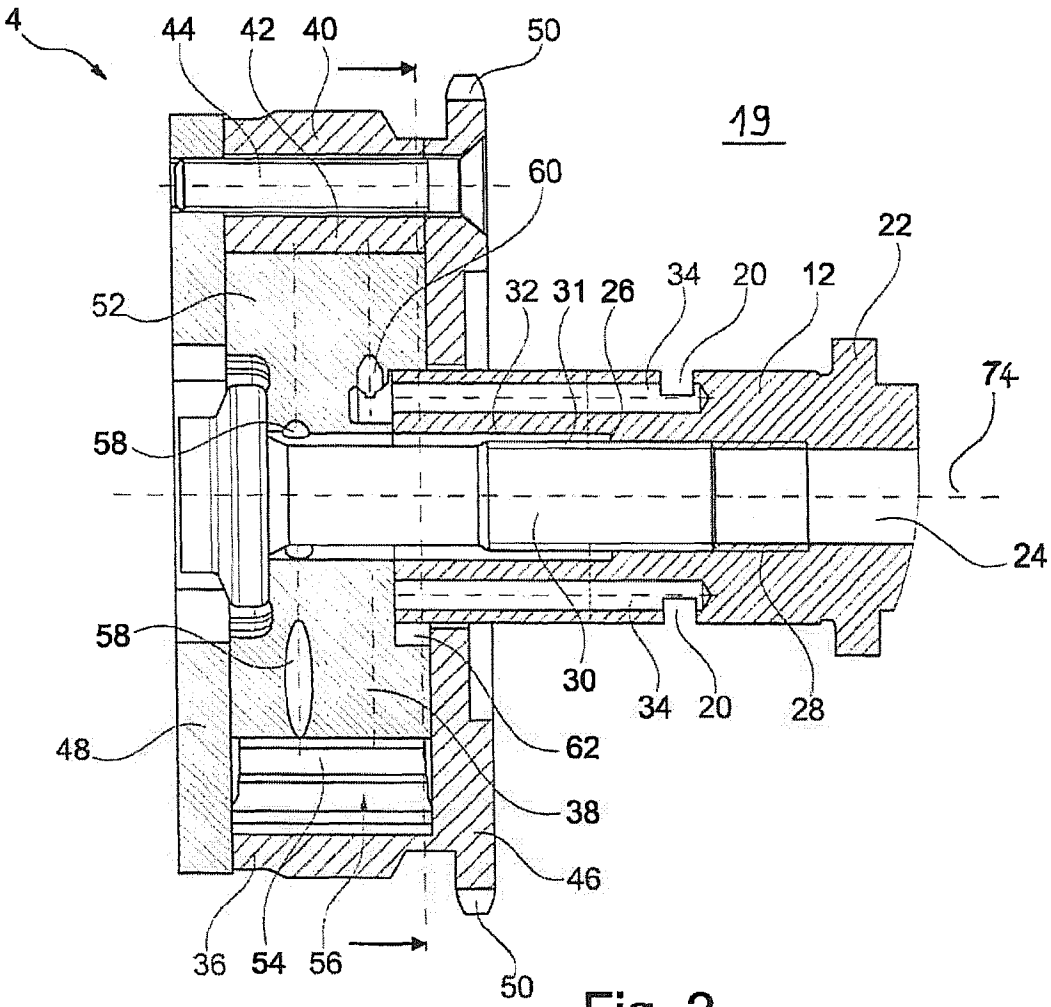
FIG. 2 shows a radial sectional view of one camshaft adjuster from FIG. 1.
Figure 3:
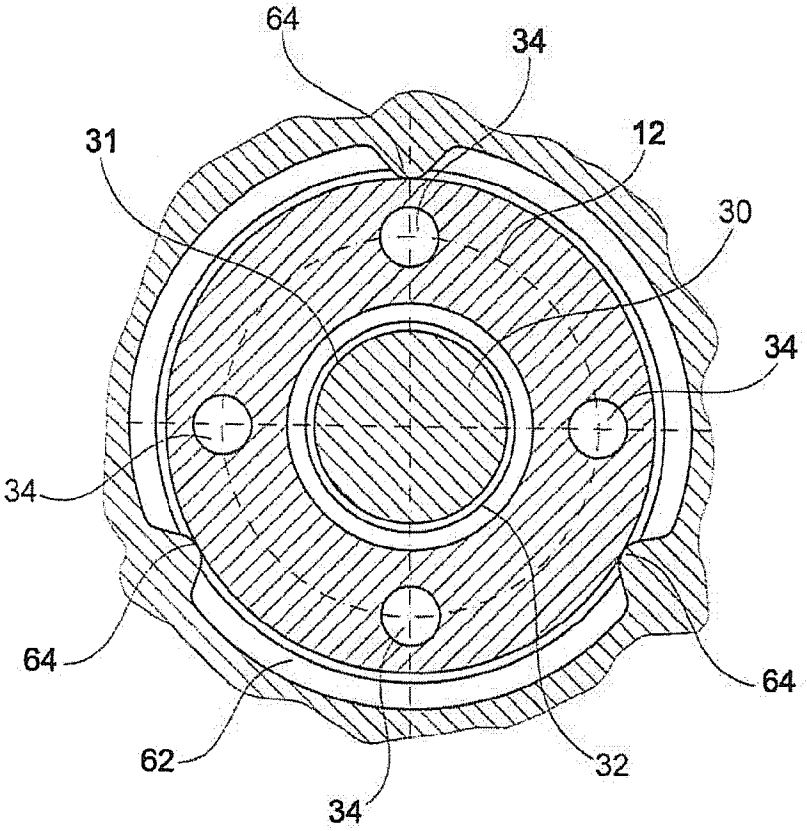
FIG. 3 shows an axial sectional view of the camshaft adjuster from FIG. 2.

Reference is hereby made to FIGS. 2 and 3, which show a radial and axial sectional view of one of camshaft adjusters 4 from FIG. 1.

Camshaft adjuster 4 is mounted on camshaft 12. Camshaft adjuster 4 and camshaft 12 together form camshaft adjusting device 19. In the present description, the axial end of camshaft 12, on which camshaft adjuster 4 is mounted, is defined as the "front" and the end opposite this axial end is defined as the "rear."

Camshaft 12 has multiple A supply connections 20 and one B supply connection, which is not illustrated, in the form of radial bores guided through the camshaft. The two supply connections 20 may be connected to a pressure port, which is not illustrated, and to a tank connection, which is not illustrated, in a manner which is known to those skilled in the art, for example via a 4/3-way valve. An axial stop 22 is furthermore provided axially upstream from A supply connections 20, via which the camshaft may be counter-supported in a bearing block, which is not illustrated.

Camshaft 12 furthermore has a stepped, axial central bore 24, one step 26 of stepped central bore 24 being provided axially between A supply connections 20 and the B supply connection, which is not illustrated. An inner thread 28, into which a central screw or a central valve body 30 having an outer thread 31 is screwed, is provided behind step 26 in central bore 24. Camshaft adjuster 4 is fastened to camshaft 12 in a manner which is still to be described via the central screw or central valve body 30.

An annular gap 32 is provided axially in front of step 26 between central screw 30 and a wall of central bore 24. The B supply connection, which is not illustrated, is inserted into this annular gap 32 in a manner which is not shown.

Furthermore, four axial bores 34, which are spaced equidistantly apart in the circumferential direction of camshaft 12 and which are each connected on their front axial end to one of A supply connections 20, penetrate camshaft 12 radially via central bore 24.

Camshaft adjuster 4 has a stator 36 and a rotor 38, which is rotatably accommodated in stator 36.

Stator 36 has an annular outer part 40, from which multiple separating elements 42 project radially to the inside. Only one of these separating elements 42 is shown in FIG. 2. Screws 44, which are provided to fasten a front cover 46 on the front of stator 36 and a sealing cover 48 on the back of stator 36, axially penetrate separating elements 42. An inner chamber surrounded by the annular outer part is axially closed in this way. Teeth 50 are provided on the radial outside of annular outer part 40, which are able to engage with driving means 18.

As mentioned above, rotor 38 is accommodated in stator 36 and rotatably fixedly connected to camshaft 12 with the aid of the central screw or central valve body 30. Rotor 38 has a hub 52, from which vanes 54 project radially and which engages between separating elements 42 of stator 36, viewed in the circumferential direction of camshaft adjuster 4. Pressure chambers are formed in this way, via which rotor 38 may be adjusted with respect to stator 36 by pumping in hydraulic fluid. Viewed in the direction of rotation of camshaft adjuster 4, a pressure chamber upstream from a vane 54 is referred to as a retarding chamber, and a pressure chamber downstream from a vane 54 is referred to as an advancing chamber. FIG. 2 shows a pressure chamber, which is to be assumed to be retarding chamber 56.

Gap 32 is continued in rotor 38. Radial retarding bores 58, which lead into retarding chambers 56, penetrate hub 52 from the gap. Only two of these retarding bores 58 are shown in FIG. 2. Some of axial bores 34 through camshaft 12 are also continued into rotor 38. Radial advancing bores 60, which lead into the advancing chambers, penetrate hub 52 from axial bores 34. Only one of advancing bores 60 is shown in FIG. 2. If hydraulic fluid is thereby pumped into camshaft adjuster 4 via A supply connections 20, the advancing chambers, which are not illustrated, are pressurized, and camshaft 12 is accelerated with respect to crankshaft 16, which is connected to stator 36 via driving means 18. In contrast, camshaft 12 is decelerated when hydraulic fluid is pumped into retarding chambers 56 via the B supply port, which is not illustrated.

To avoid camshaft adjuster 4 generating imbalances during the rotation of camshaft 12, camshaft adjuster 4 must be mounted on camshaft 12 centrically to rotation axis 74. For this purpose, hub 52 of rotor 38 has a receiving bushing 62, which is axially indented from the back of camshaft adjuster 4 and into which camshaft 12 is inserted. Within receiving bushing 62, camshaft 12 is supported by three spacer elements 64, which radially fix camshaft 12 with respect to rotor 38 and thus to camshaft adjuster 4. Hub 52 with receiving bushing 62 and spacer elements 64 situated on the inner wall of receiving bushing 62 is manufactured by sintering. The radial dimensions of spacer elements 64 are set by calibration after the sintering process.

Spacer elements 64 will be discussed in greater detail on the basis of FIGS. 4 through 6.

Figure 4:
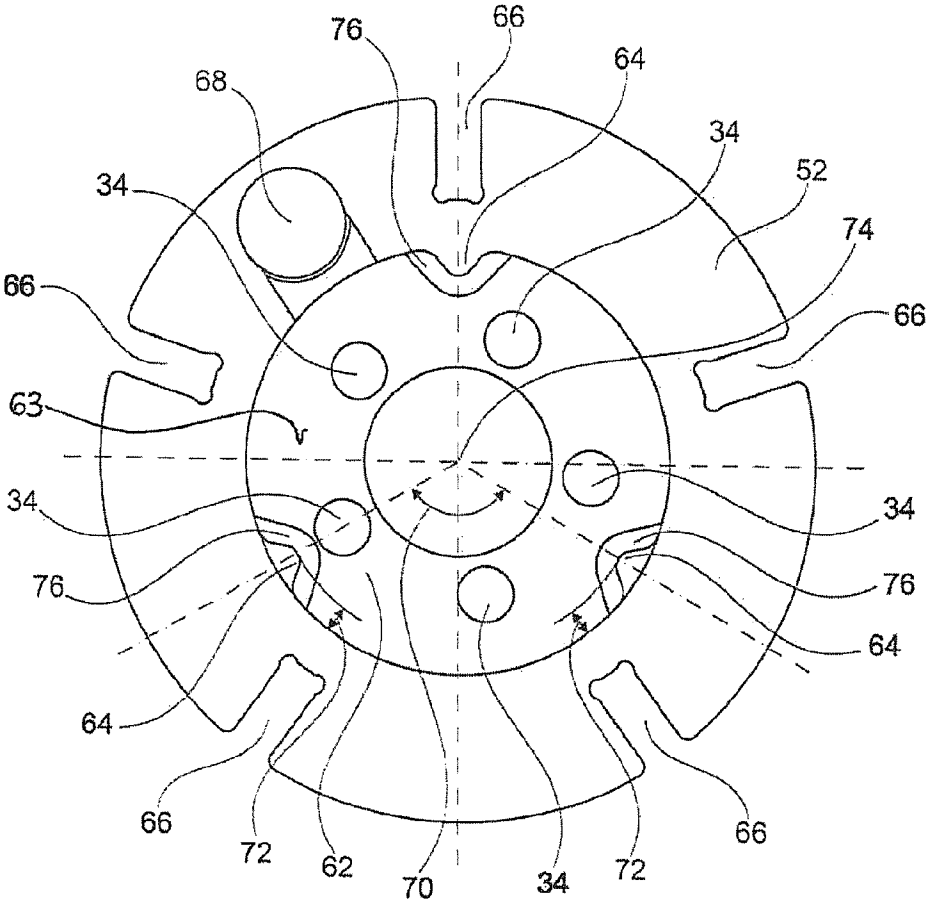
FIG. 4 shows an axial top view of a hub of an alternative rotor of the camshaft adjuster from FIG. 2.
Figure 5:
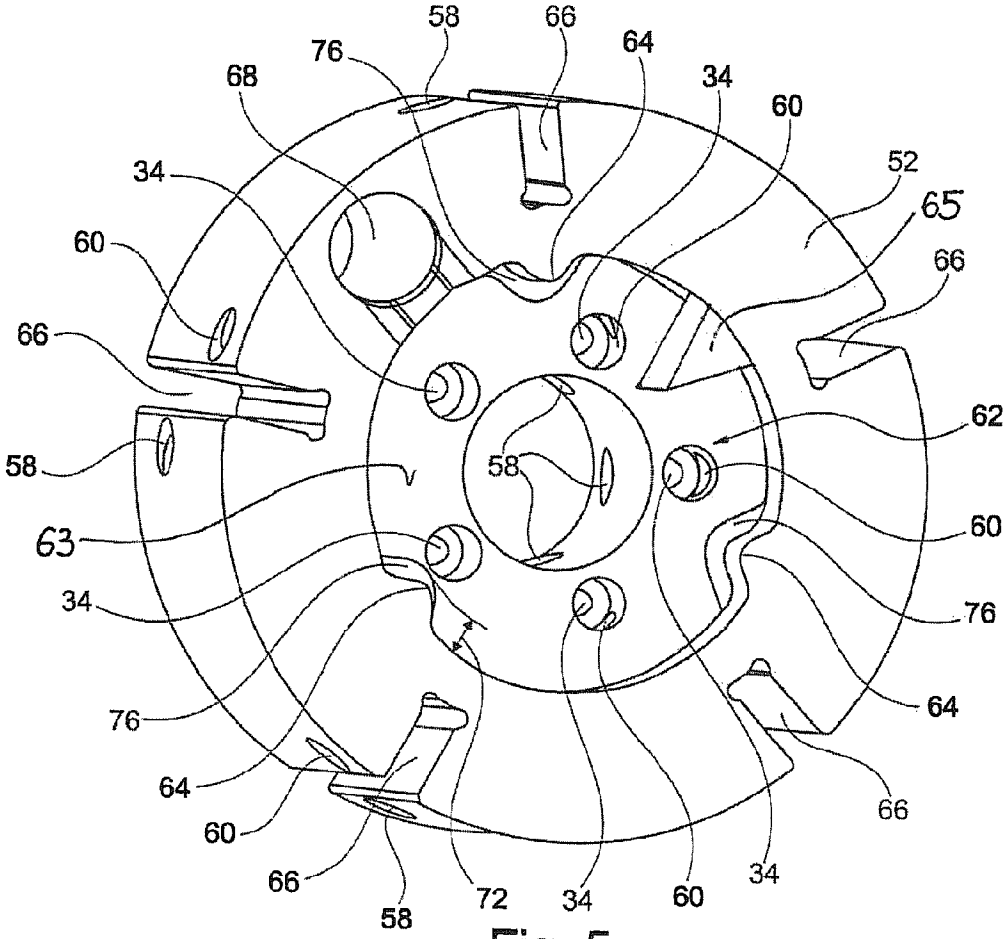
FIG. 5 shows a perspective view of the hub from FIG. 4.
Figure 6:
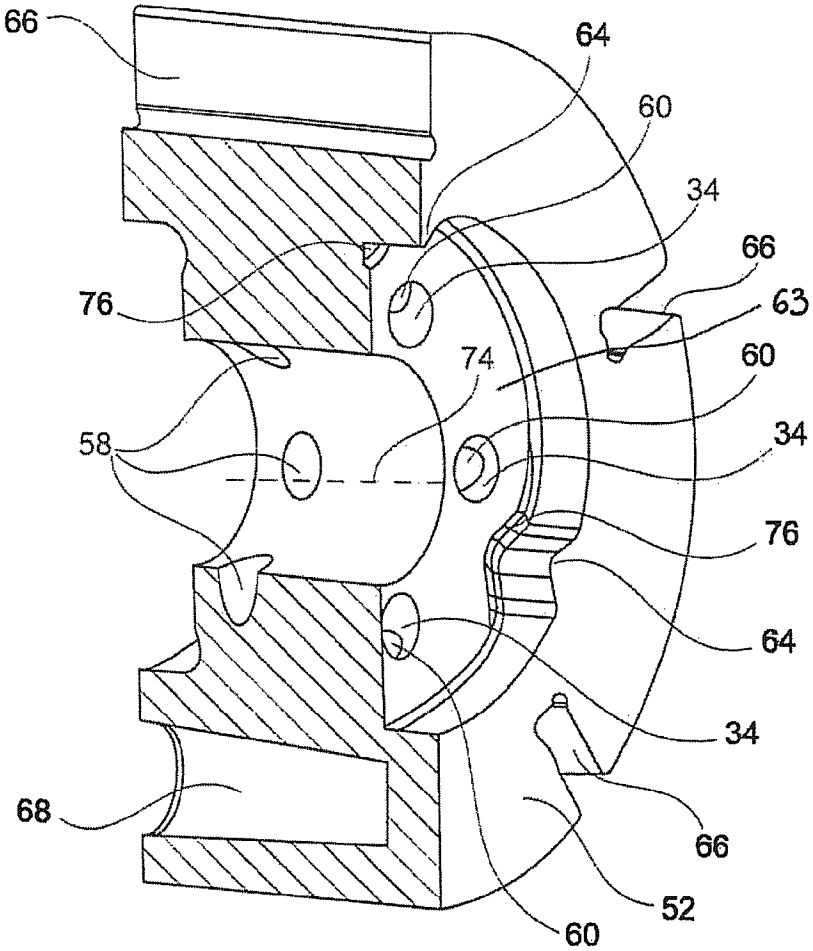
FIG. 6 shows a broken open perspective view of the hub from FIG. 4.

FIGS. 4 through 6 show another example of a hub 52 of rotor 38 of camshaft adjuster 4 in an axial top view, in a perspective view and in a broken open perspective view.

In FIGS. 4 through 6, hub 52 has five vane grooves 66, into which vanes 54 may be inserted. In this way, five advancing chambers and five retarding chambers 56 may be formed by a corresponding stator 36, which has five separating elements 42. These adjusting chambers are supplied with hydraulic fluid through five advancing bores 60 and five retarding bores 58. Correspondingly, five axial bores 34, which are connectable to A supply connection 20 in the manner described in FIG. 2, lead to five advancing bores 60. Five retarding bores 58 lead into gap 32 described in FIG. 2, which is connectable to the B supply connection.

An axial locking pin bore 68 is furthermore provided in hub 52, in which a locking pin, which is not illustrated, may be guided, which is able to secure a certain rotational position of stator 36 with respect to rotor 38 in a manner which is known to those skilled in the art.

In the present embodiment, spacer elements 64 are designed to taper radially to the inside and be spaced a distance apart at a 120° angle 70. Spacer elements 64 extend in the axial direction. An axially running line results for each spacer element 64 as the contact surface for an essentially cylindrical camshaft 12. The radial position and angular position of camshaft 12 are definitively established via the three spacer elements 64. Radial height 72 of spacer elements 64 may decrease in the axial direction counter to the joining direction of camshaft 12 in a manner which is not illustrated. In this way, spacer elements 64 may grip camshaft 12 during insertion into receiving bushing 62 and center it with respect to a center point 74 or a rotation axis 74.

Axial indentations 76 are introduced around the bottom or root area of spacer elements 64, which rest on base 63 of receiving bushing 62. These axial indentations 76 facilitate a flat support of the front of camshaft 12 on base 63. An undesirable impact of an outer edge of camshaft 12 on the radial transition in the root area of spacer elements 64 is avoided.

According to FIG. 5, a form-fitting element 65 is provided on base 63 of receiving bushing 62, which forms a form fit with a complementary form-fitting element on the front of camshaft 12 when camshaft 12 is inserted. The form fit formed hereby on the front of inserted camshaft 12 permits the transmission of higher torques. Due to single form-fitting element 65, the mounting of camshaft 12 in receiving bushing 62 is possible in only one specific rotational position.

To manufacture illustrated hub 52, hub 52 may initially be sintered with spacer elements 64. Radial height 72 of spacer elements 64 may then be calibrated, for example using a noncutting machining method with the aid of a suitable form tool. To finish rotor 38, vanes 54 may be inserted into vane grooves 66 in hub 52. After mounting rotor 38 in a stator 36 (see FIG. 2), camshaft 12 may be introduced into receiving bushing 62 and fixed radially. Camshaft 12 may then be tightened axially with the aid of a central screw or a central valve body 30.

LIST OF REFERENCE NUMERALS

2 Internal combustion engine
4 Camshaft adjuster
6 Combustion chamber
8 Valve
10 Cam
12 Camshaft
14 Reciprocating piston
16 Crankshaft

18 Driving means
19 Camshaft adjusting device
20 A supply connection
22 Axial stop
24 Central bore
26 Axial step
28 Inner thread
30 Central screw
31 Outer thread
32 Gap
34 Axial bore
36 Stator
38 Rotor
40 Outer part
42 Separating element
44 Screw
46 Front cover
48 Sealing cover
50 Tooth
52 Hub
54 Vane
56 Retarding chamber
58 Retarding bore
60 Advancing bore
62 Receiving bushing
63 Base
64 Spacer elements
65 Form-fitting element
66 Vane groove
68 Axial locking pin bore
70 Angle
72 Radial height
74 Rotation axis
76 Axial indentation

What is claimed is:

1. A camshaft adjusting device comprising:

a camshaft adjuster including a stator, a rotor rotatable relative to the stator around a rotation axis, and a hub situated on the rotor or on the stator and having a receiving bushing; and a camshaft accommodated in the receiving bushing, the camshaft being radially fixed in the receiving bushing with aid of at least three spacer elements wherein the spacer elements are situated on an inner wall of the receiving bushing and contact a cylindrical outer surface of the camshaft.

2. The camshaft adjusting device as recited in claim 1 wherein at least two of the spacer elements are situated offset from each other in the axial direction.

3. The camshaft adjusting device as recited in claim 1 wherein the spacer elements extend in the axial direction.

4. The camshaft adjusting device as recited in claim 3 wherein the spacer elements extend in the axial direction to a base of the receiving bushing, and indentations are introduced into the base, the indentations surrounding each of the spacer elements.

5. The camshaft adjusting device as recited in claim 1 wherein the spacer elements taper in the radial direction of the camshaft.

6. The camshaft adjusting device as recited in claim 1 wherein a contact area between the camshaft and a particular spacer element is provided as an axial contact line.

7. The camshaft adjusting device as recited in claim 1 further comprising at least one form-fitting element situated on a base of the receiving bushing, the receiving bushing being rotatably fixedly coupled with a complementary form-fitting element on a front of the camshaft.

8. The camshaft adjusting device as recited in claim 1 wherein the receiving bushing is situated on the rotor.

9. A method for manufacturing a camshaft adjusting device comprising the steps of:

mounting a rotor and a stator relative to each other, and rotatably with respect to a camshaft adjuster, the camshaft adjuster being centered on a camshaft;

powder-metallurgically manufacturing a hub for the rotor or for the stator, the hub including a receiving bushing and at least three spacer elements situated on an inner wall of the receiving bushing, radial tolerances of the spacer elements being set with the aid of calibration; and introducing the camshaft into the receiving bushing and fixing the camshaft radially to the receiving bushing with aid of the spacer elements contacting a cylindrical surface of the camshaft.

* * * * *